US010557468B2

(12) United States Patent
Sakai et al.

(10) Patent No.: US 10,557,468 B2
(45) Date of Patent: Feb. 11, 2020

(54) FUEL PUMP

(71) Applicant: DENSO CORPORATION, Kariya, Aichi-pref. (JP)

(72) Inventors: Hiromi Sakai, Kariya (JP); Daiji Furuhashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 39 days.

(21) Appl. No.: 15/768,592

(22) PCT Filed: Oct. 28, 2016

(86) PCT No.: PCT/JP2016/081992

§ 371 (c)(1),
(2) Date: Apr. 16, 2018

(87) PCT Pub. No.: WO2017/077948

PCT Pub. Date: May 11, 2017

(65) Prior Publication Data

US 2018/0306148 A1 Oct. 25, 2018

(30) Foreign Application Priority Data

Nov. 3, 2015 (JP) ..... 2015-216225

(51) Int. Cl.
*F04C 2/10* (2006.01)
*F04C 15/06* (2006.01)
(Continued)

(52) U.S. Cl.
CPC ..... *F04C 2/102* (2013.01); *F02M 37/08* (2013.01); *F02M 37/10* (2013.01); *F04C 2/10* (2013.01);
(Continued)

(58) Field of Classification Search
CPC ..... F02M 37/10; F02M 37/08; F04C 13/008; F04C 2/102; F04C 2/10; F04C 15/06;
(Continued)

(56) References Cited

U.S. PATENT DOCUMENTS 2,380,783 A * 7/1945 Painter ..... F04C 2/102 417/310
2,417,701 A * 3/1947 Parsons ..... F04C 2/102 418/131
(Continued)

FOREIGN PATENT DOCUMENTS

JP 60247080 A * 12/1985 ..... F04C 2/102
JP 61-49086 4/1986
(Continued)

*Primary Examiner* — Sizo B Vilakazi
*Assistant Examiner* — Brian R Kirby
(74) *Attorney, Agent, or Firm* — Nixon & Vanderhye PC

(57) ABSTRACT

The pump housing includes a pair of sliding surfaces clamping the outer and inner gears from both their sides to allow both the gears to slide on the sliding surfaces, a suction port part suctioning fuel from outside into inside of the gear accommodation chamber, and a discharge port part discharging fuel from inside into outside of the gear accommodation chamber. At least one of the suction port part and the discharge port part includes an elongated groove that is depressed from the corresponding sliding surface and extends along a circumferential direction of the pump housing in a region opposed to the pump chambers, opening bores that open on the elongated groove from outside of the gear accommodation chamber, and ribs each of which is arranged between the corresponding adjacent two opening bores. The opening bores and the ribs are arranged alternately along an extending direction of the elongated groove.

13 Claims, 7 Drawing Sheets

(51) Int. Cl.
*F02M 37/08* (2006.01)
*F04C 13/00* (2006.01)
*F02M 37/10* (2006.01)

(52) U.S. Cl.
CPC ..... *F04C 13/008* (2013.01); *F04C 15/06* (2013.01); *F04C 2210/203* (2013.01); *F04C 2250/101* (2013.01); *F04C 2250/102* (2013.01)

(58) Field of Classification Search
CPC ..... F04C 2250/102; F04C 2210/203; F04C 2250/101
USPC ..... 123/495, 497
See application file for complete search history.

(56) References Cited

U.S. PATENT DOCUMENTS 3,303,783 A * 2/1967 Neubauer ..... F04C 14/04 418/32
3,356,032 A * 12/1967 Roeske ..... F23K 5/142 418/180
4,008,018 A * 2/1977 McDermott ..... F01C 21/18 418/171
4,443,169 A * 4/1984 Merz ..... F04C 15/066 418/15
4,596,519 A * 6/1986 Tuckey ..... F04C 11/008 418/133
5,156,540 A * 10/1992 Fernau ..... F04C 2/082 418/152
5,263,818 A * 11/1993 Ito ..... F02M 37/08 418/15
5,713,726 A * 2/1998 Nakayoshi ..... F04C 14/26 417/292
5,997,262 A * 12/1999 Finkbeiner ..... F02M 37/041 417/410.4
6,074,189 A * 6/2000 Eckerle ..... F04C 2/102 418/109
6,109,615 A * 8/2000 Gildea ..... F16H 48/08 277/349
6,179,596 B1 * 1/2001 Weisener ..... F04C 2/102 418/166
6,474,937 B1 * 11/2002 Rothkopf ..... F04D 5/002 415/55.1
6,551,083 B2 * 4/2003 Weisener ..... F04C 2/102 29/888.023
6,607,370 B2 * 8/2003 Fukamachi ..... F04D 13/027 417/420
6,769,889 B1 * 8/2004 Raney ..... F04C 2/102 384/278
7,922,468 B2 * 4/2011 Chang ..... F04C 2/086 418/171
2002/0015653 A1 * 2/2002 Weisener ..... F04C 2/102 418/166
2004/0191074 A1 9/2004 Kajita
2005/0084391 A1 * 4/2005 Grant ..... B01D 35/26 417/313
2006/0153706 A1 * 7/2006 Barth ..... F04C 2/102 417/410.4
2008/0112821 A1 5/2008 Morris
2008/0159884 A1 * 7/2008 Nakanishi ..... F04C 2/084 417/410.4
2015/0267699 A1 * 9/2015 Pippes ..... F04C 2/084 417/410.4

FOREIGN PATENT DOCUMENTS

JP S6149086 * 4/1986
JP S6149086 U * 4/1986
JP 2004-301044 10/2004
JP 2005-069004 3/2005
JP 2007-263019 10/2007
JP 2008-128050 6/2008
JP 2008-215100 9/2008
JP 2008-231982 10/2008
JP 2011-052632 3/2011
JP 2014-526648 10/2014

* cited by examiner

FUEL PUMP

CROSS REFERENCE TO RELATED APPLICATION

This application is the U.S. national phase of International Application No. PCT/JP2016/081992 filed Oct. 28, 2016, which designated the U.S. and claims priority to Japanese Patent Application No. 2015-216225 filed on Nov. 3, 2015, the entire contents of each of which are hereby incorporated herein by reference.

TECHNICAL FIELD

The present disclosure relates to a fuel pump that sucks fuel into a gear accommodation chamber and then discharges the fuel.

BACKGROUND ART

There has been known a fuel pump that sucks fuel into a gear accommodation chamber and then discharges the fuel. A fuel pump disclosed in Patent Document 1 includes an outer gear having a plurality of internal teeth, an inner gear that has a plurality of external teeth and eccentrically engages with the outer gear, and a pump housing that defines a gear accommodation chamber in which the outer gear and the inner gear are rotatably accommodated. In the fuel pump, the outer gear and the inner gear rotate while expanding and reducing a volume of each of a plurality of pump chambers formed between the gears, thereby fuel is sucked into the gear accommodation chamber and then discharged.

In detail, the pump housing disclosed in the Patent Document 1 includes a pair of sliding surfaces that clamps the outer gear and the inner gear from both sides so that the gears slide on the surfaces, a suction port part that sucks the fuel from the outside to the inside of the gear accommodation chamber, and a discharge port part that discharges the fuel from the inside to the outside of the gear accommodation chamber.

Each of the suction port part and the discharge port part has two opening bores that are opened to a portion, which is opposed to a pump chamber, of the sliding surface from the outside of the gear accommodation chamber, and one rib disposed between the two opening bores.

PRIOR ART DOCUMENT

Patent Document

Patent Document 1: JP2004-301044A

In the fuel pump, deformation of the sliding surface may occur, for example, in assembling of components of the fuel pump during manufacturing, or, for example, due to a temperature variation during use. However, since the rib of the Patent Document 1 improves stiffness of the pump housing, deformation of the sliding surface is suppressed, resulting in a reduction in sliding resistance during rotation of the outer gear and the inner gear.

On the other hand, the opening bores in the Patent Document 1 are directly opened to the sliding surface, and the rib between the opening bores configures a part of the sliding surface. Hence, suction or discharge of the fuel in the pump chamber opposed to the rib is hindered by the rib, leading to a reduction in pump efficiency.

SUMMARY OF INVENTION

The present disclosure addresses the above issues. Thus, it is an objective of the present disclosure to provide a fuel pump having a high pump efficiency.

To achieve the objective, a fuel pump in an aspect of the present disclosure includes an outer gear that includes a plurality of internal teeth, an inner gear that includes a plurality of external teeth and is eccentric relative to the outer gear in an eccentric direction to be engaged with the outer gear, and a pump housing that defines a gear accommodation chamber, which rotatably accommodates the outer gear and the inner gear. The outer gear and the inner gear expand and contract volumes of a plurality of pump chambers formed between both the gears, and rotate to suction fuel into the gear accommodation chamber and then discharge fuel from the gear accommodation chamber. The pump housing includes a pair of sliding surfaces that clamp the outer gear and the inner gear from both their sides to allow both the gears to slide on the pair of sliding surfaces, a suction port part that suctions fuel from outside into inside of the gear accommodation chamber, and a discharge port part that discharges fuel from the inside into the outside of the gear accommodation chamber. At least one of the suction port part and the discharge port part includes an elongated groove that is depressed from a corresponding one of the pair of sliding surfaces and extends along a circumferential direction of the pump housing in a region opposed to the plurality of pump chambers, a plurality of opening bores that open on the elongated groove from the outside of the gear accommodation chamber, and a plurality of ribs each of which is arranged between corresponding adjacent two of the plurality of opening bores. The plurality of opening bores and the plurality of ribs are arranged alternately along an extending direction of the elongated groove.

In this aspect, the opening bores and the ribs are alternately arranged along the extending direction of the elongated groove in at least one of the suction port part and the discharge port part. The plurality of opening bores are provided to be opened to the elongated groove from the outside of the gear accommodation chamber, and the ribs are disposed between the opening bores. Such alternate arrangement makes it possible to improve stiffness of the pump housing even when the plurality of opening bores are provided.

Such an elongated groove having the plurality of opening bores is depressed from the sliding surface and thus provided to extend along a circumferential direction of the pump housing in a portion opposed to the plurality of pump chambers formed between the outer gear and the inner gear. The volume of each pump chamber opposed to such an elongated groove is expanded and reduced along with rotation of the gears. The fuel is sucked into the gear accommodation chamber and then discharged by the expansion and reduction.

The pump chamber opposed to each opening bore directly sucks or discharges the fuel from/into the corresponding opening bore. The pump chamber opposed to each rib sucks or discharges the fuel from/into the opening bores on both sides of the rib through a space in the elongated groove. Thus, since the pump chambers opposed to the port part can successively perform suction or discharge of the fuel, the fuel is sucked or discharged successfully using the expansion and reduction of the volume of the pump chamber. It is therefore possible to provide a fuel pump having a high pump efficiency.

BRIEF DESCRIPTION OF DRAWINGS

The above and other objects, features and advantages of the present disclosure will become more apparent from the following detailed description made with reference to the accompanying drawings. In the drawings:

FIG. 10A shows the suction port part, and FIG. 10B shows the discharge port part.

EMBODIMENTS FOR CARRYING OUT INVENTION

Figure 1:
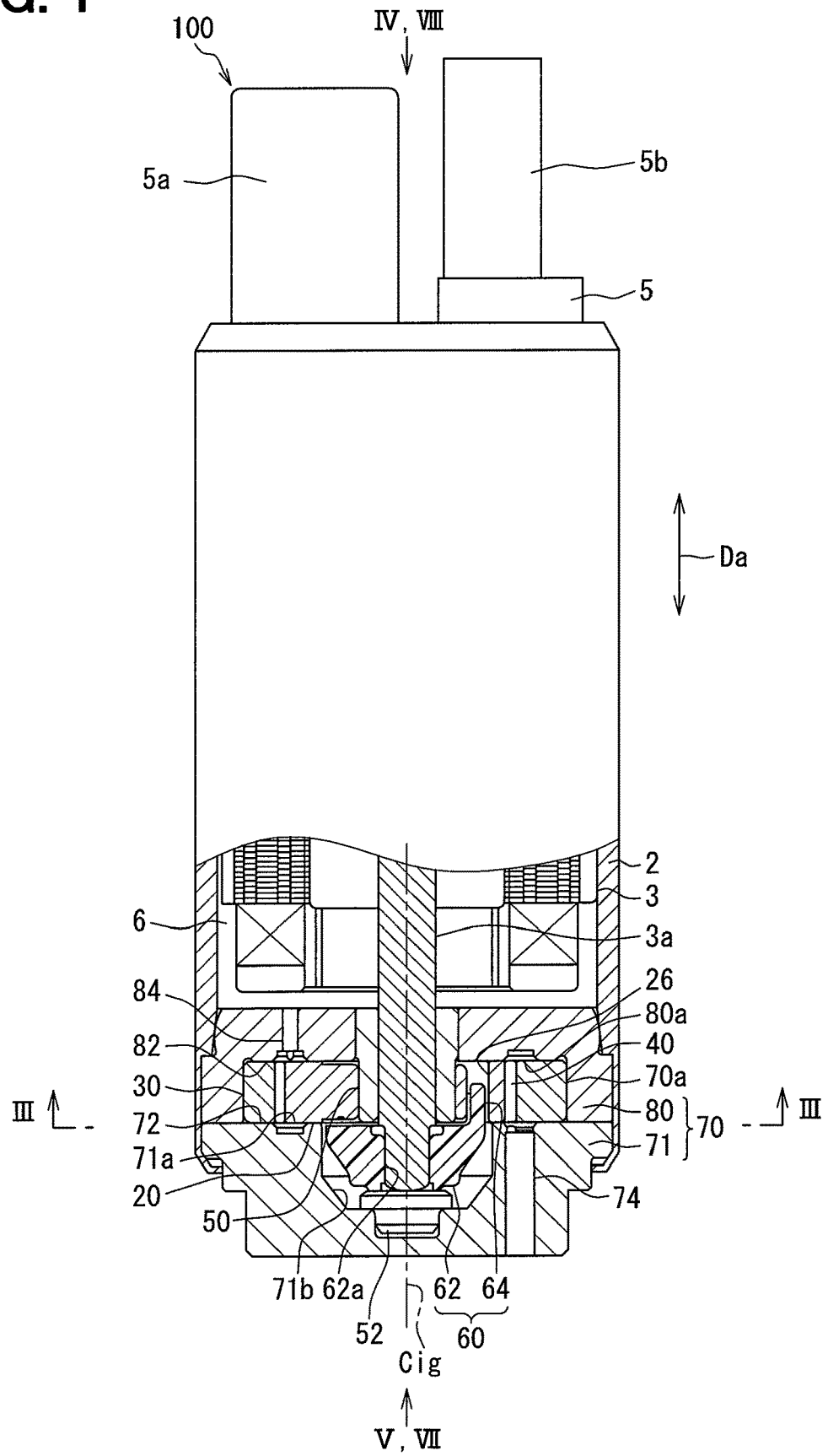
FIG. 1 is a partial sectional front view illustrating a fuel pump of a first embodiment.

Hereinafter, some embodiments will be described with reference to drawings. In the embodiments, corresponding components are designated by the same reference numeral, and duplicated description may be omitted. When only a portion of a configuration is described in each embodiment, previous description of another embodiment can be applied to other portions of the configuration. Not only a combination of configurations specified in description of each embodiment but also a combination of configurations in several embodiments can be used while being not specified as long as such a combination is not particularly disadvantageous.

First Embodiment

A fuel pump 100 of a first embodiment is a positive displacement trochoid pump as shown in FIG. 1. The fuel pump 100 is a diesel pump that is mounted in a vehicle and used to pressure-feed light oil that is a fuel used for combustion in an internal combustion engine and has a viscosity higher than gasoline. The fuel pump 100 is mainly configured of an electromotive motor 3 accommodated within a circular pump body 2, a pump body 10, and a side cover 5 that clamps the electromotive motor 3 in an axial direction Da and hangs to the outside from a side opposite to the pump body 10.

In the fuel pump 100, a rotation shaft 3*a* of the electromotive motor 3 is energized from an external circuit via an electric connector 5*a* of the side cover 5 and rotated. An outer gear 30 and an inner gear 20 of the pump body 10 rotate using a driving force of the rotation shaft 3*a*. As a result, fuel is sucked into a cylindrical gear accommodation chamber 70*a*, in which the gears 20 and 30 are accommodated and pressurized therein. The fuel is then discharged from a discharge outlet 5*b* of the side cover 5 through a fuel passage 6 outside the gear accommodation chamber 70*a*.

The electromotive motor 3 used in such a fuel pump 100 of the first embodiment is an inner-rotor brushless motor having four magnets and six coils disposed in respective six slots. For example, when an operation of turning on an ignition key of a vehicle or an operation of stepping on an accelerator pedal of the vehicle is performed, positioning control is performed in response to the operation so that the rotation shaft 3*a* is rotated in a drive rotation direction or in a counter drive rotation direction by the electromotive motor 3. Subsequently, drive control is performed so that the rotation shaft 3*a* is rotated in the drive rotation direction from the position determined by the positioning control.

The drive rotation direction means a direction corresponding to a positive direction (see FIG. 3) of a rotational direction Rig about an inner center line Cig of the inner gear 20. The counter drive rotation direction means a direction corresponding to a negative direction (see FIG. 3) of the rotational direction Rig.

The pump body 10 is now described in detail further with reference to FIGS. 2 to 9. The pump body 10 includes a joint member 60, the inner gear 20, the outer gear 30, and a pump housing 70.

Figure 2:
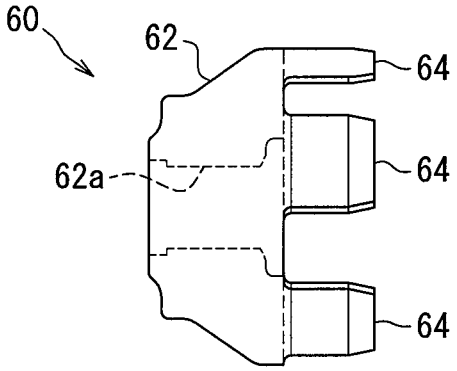
FIG. 2 is a front view illustrating a joint member in the first embodiment.
Figure 3:
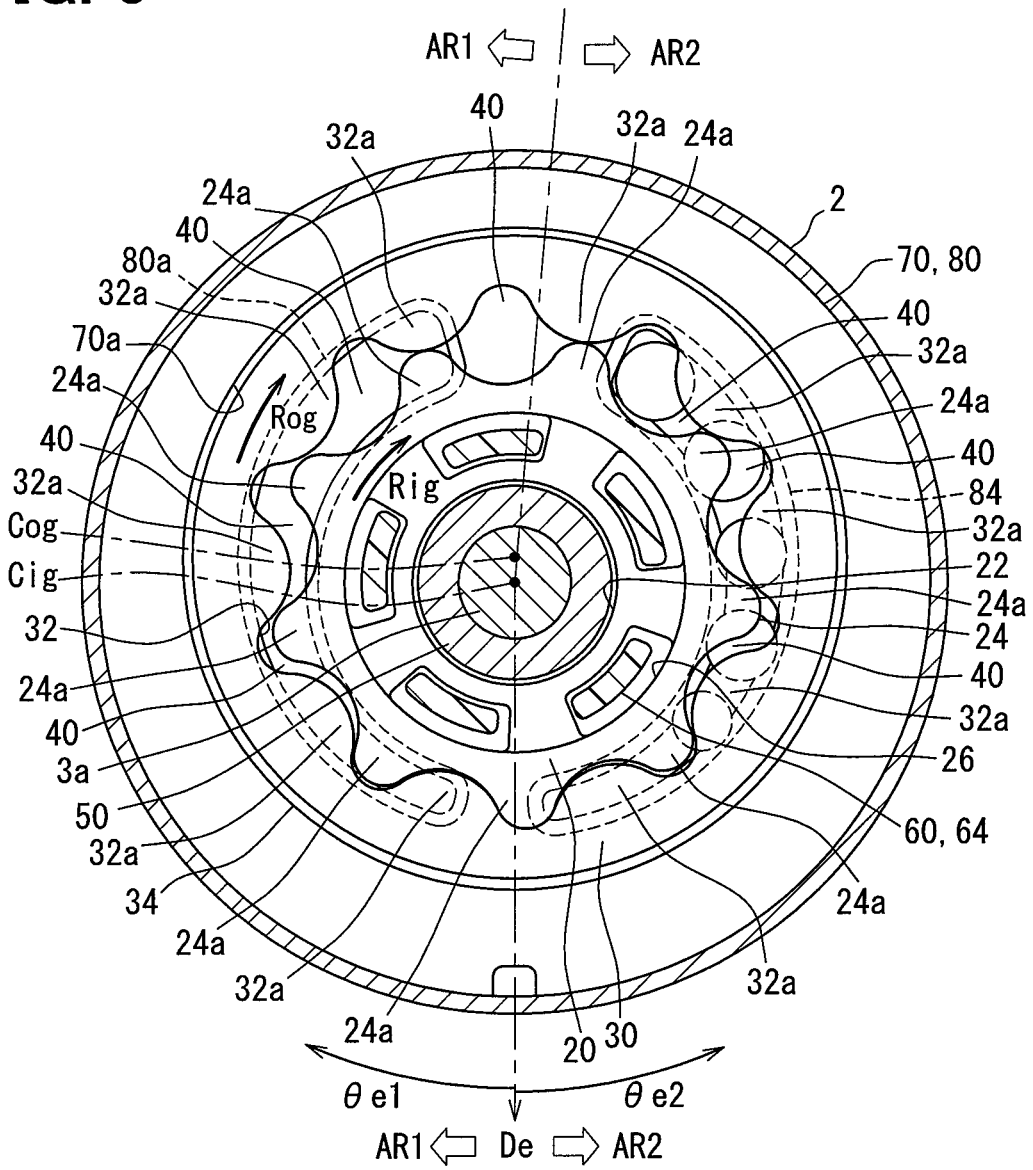
FIG. 3 is a sectional view along a line III-Ill in FIG. 1.

The joint member 60 shown in FIGS. 1 to 3 is made of a synthetic resin such as, for example, polyphenylene sulfide (PPS) resin, and links the rotation shaft 3*a* to the inner gear 20. The joint member 60 integrally includes a body portion 62 and a plurality of insertion portions 64. Specifically, as shown in detail in FIG. 2, the body portion 62 is formed in a truncated cone shape, and has a fitting hole 62*a* on the inner center line Cig. The body portion 62 is fitted with a tip portion of the rotation shaft 3*a*, which passes through the gear accommodation chamber 70*a* from a side close to the electromotive motor 3 to the opposite side, through the fitting hole 62*a*. The plurality of insertion portions 64 are provided at equal intervals in a circumferential direction. Each insertion portion 64 has a shape of extending toward the gear accommodation chamber 70*a* along an axial direction Da from a position on an outer periphery side of the fitting hole 62*a* of the body portion 62, and is thus flexible.

The inner gear 20 shown in FIGS. 1 and 3 is what is called a trochoid gear with the teeth each showing a trochoid curve. The inner gear 20 shares the inner center line Cig as its center with the rotation shaft 3*a*, and is thus disposed eccentrically in the gear accommodation chamber 70*a*.

The inner gear 20 has a plurality of insertion holes 26 in a portion opposed to the body portion 62 of the joint member 60 in the axial direction Da. The plurality of insertion holes 26 are provided in a circumferential direction at equal intervals in correspondence to the insertion portions 64. Specifically, five insertion portions 64 and five insertion holes 26 are provided in the first embodiment in order to reduce influence of a torque ripple of the electromotive motor 3 because five is a number different from the number of poles and the number of slots of the electromotive motor 3, and is particularly a prime number. Each insertion hole 26 passes through the inner gear 20 along the axial direction Da.

A corresponding insertion portion 64 lies with a gap in each insertion hole 26 in an insertional manner. When the rotation shaft 3*a* is rotated in the drive rotation direction, the insertion portion 64 abuts with the insertion hole 26, thereby driving force of the rotation shaft 3*a* is transmitted to the inner gear 20 via the joint member 60. That is, the inner gear 20 is rotatable in a rotational direction Rig around the inner center line Cig. In FIG. 3, only one insertion hole 26 and only one insertion portion 64 are each marked with a reference numeral.

As shown in FIG. 3, the inner gear 20 has a plurality of external teeth 24*a*, which are arranged in the rotational direction Rig at equal intervals, in its peripheral portion 24. The external teeth 24*a* are formed in such a manner that their addendums projecting from the tooth roots to the outer circumferential side are along a circular circumcircle (also referred to as addendum circle).

The outer gear 30 shown in FIGS. 1 and 3 is also what is called a trochoid gear with the teeth each showing a trochoid curve. The outer gear 30 is eccentric to the inner center line Cig of the inner gear 20 and disposed coaxially within the gear accommodation chamber 70*a*. As a result, the inner gear 20 is eccentric to the outer gear 30 in an eccentric direction De as a radial direction of the outer gear 30.

The outer gear 30 is rotatable in conjunction with the inner gear 20 in a rotational direction Rog around an outer center line Cog eccentric to the inner center line Cig. The outer gear 30 has a plurality of internal teeth 32*a*, which are arranged at equal intervals in such a rotational direction Rog, in its inner peripheral portion 32. The number of the internal teeth 32*a* of the outer gear 30 is set to be larger by one than the number of the external teeth 24*a* of the inner gear 20. In the first embodiment, the number of the internal teeth 32*a* is ten, and the number of the external teeth 24*a* is nine.

The inner gear 20 engages with the outer gear 30 relatively eccentrically in an eccentric direction De. As shown in FIG. 3, on a plane perpendicular to the axial direction Da, assuming the center of the inner gear 20 intersecting the inner center line Cig is an apex, an angle formed by the axial direction Da is defined as a deviation angle θe1 or θe2, and the gears 20 and 30 engage with each other with a small gap in a portion providing a small deviation angle θe1 or θe2. On the other hand, a plurality of pump chambers 40 are formed in series between the gears 20 and 30 in a portion providing a large deviation angle θe1 or θe2.

The volume of such a pump chamber 40 is expanded and reduced through rotation of the outer gear 30 and the inner gear 20. For example, in the first embodiment, the gear accommodation chamber 70*a* in a range of the deviation angle θe1 from 0° to slightly beyond 180° in the drive rotation direction is formed as a suction area AR1 used for suction of the fuel according to the expansion of the respective pump chambers 40. On the other hand, for example, the gear accommodation chamber 70*a* excluding the suction area AR1, i.e., in a range of the deviation angle θe2 from 0° to less than 180° in the counter drive rotation direction, is formed as a discharge area AR2 used for discharge of the fuel according to a reduction in the respective pump chambers 40.

As shown in FIG. 1, the pump cover 71 and the pump casing 80 are superposed each other in the axial direction Da, thereby the pump housing 70 defines the gear accommodation chamber 70*a* having a cylindrical bore shape rotatably accommodating the gears 20 and 30. As a result, the pump housing 70 clamps the gears 20 and 30 from both sides in the axial direction Da, and thus forms a pair of sliding surfaces 72 and 82, on which the gears 20 and 30 slide, in a planar shape.

The pump cover 71 shown in FIGS. 1 and 4 to 6 is a component of the pump housing 70. The pump cover 71 has a disc shape having wear resistance formed by performing surface treatment such as plating on a stiff substrate including metal such as steel. The pump cover 71 hangs to the outside from an end on a side opposite to a side close to the electromotive motor 3 in the axial direction Da in the pump body 2.

The pump cover 71 has a joint accommodation chamber 71*b* accommodating the joint member 60. Specifically, the joint accommodation chamber 71*b* is depressed along the axial direction Da from the sliding surface 72 of the pump cover 71 in a portion opposed to the inner gear 20 on the inner center line Cig. The joint accommodation chamber 71*b* is in communication with the gear accommodation chamber 70*a* and thus rotatably accommodates the body portion 62 of the joint member 60. A thrust bearing 52 is fixedly fitted on the bottom of the joint accommodation chamber 71*b* on the inner center line Cig in order to bear the rotation shaft 3*a* in the axial direction Da.

The pump cover 71 has a suction port part 74, which sucks the fuel from the outside to the inside of the gear accommodation chamber 70*a*, on the outer periphery side of the joint accommodation chamber 71*b*. The suction port part 74 has an elongated groove 75, a plurality of opening bores 77*a*, 77*b*, 77*c*, 77*d*, and 77*e*, and a plurality of ribs 78*a*, 78*b*, 78*c*, and 78*d*.

Figure 4:
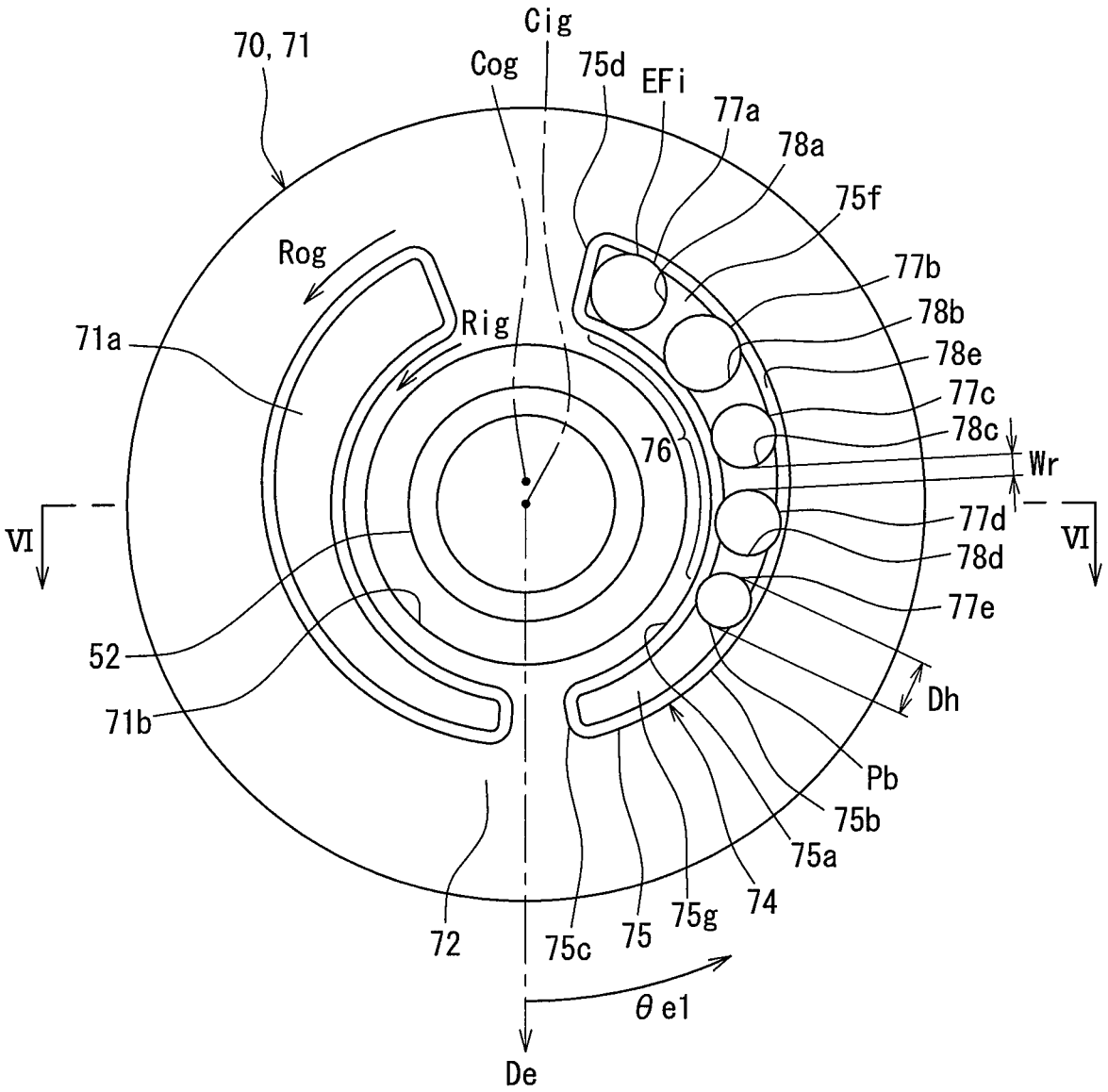
FIG. 4 is a plan view of a pump cover as seen in a IV direction in FIG. 1.

As specifically shown in FIG. 4, the elongated groove 75 is formed by being depressed from the same sliding surface 72 as the sliding surface, from which the joint accommodation chamber 71*b* is depressed, in a portion opposed to the pump chambers 40 located in the suction area AR1 of the gear accommodation chamber 70*a*. The elongated groove 75 has an arcuate groove shape extending along the circumferential direction of the pump cover 71. In detail, an inner peripheral contour 75*a* of the elongated groove 75 extends in a length shorter than the semicircle along the rotational direction Rig. An outer peripheral contour 75*b* of the elongated groove 75 extends in a length shorter than the semicircle along the rotational direction Rog.

The elongated groove 75 is gradually widened as going from a beginning portion 75*c* to an end portion 75*d* in the drive rotation direction. In other words, the elongated groove 75 is gradually widened as going from a small deviation-angle side, on which the deviation angle θe1 is small, to a large deviation-angle side, on which the deviation angle θe1 is large. Inside each of the inner peripheral contour 75*a* and the outer peripheral contour 75*b* of the elongated groove 75, the elongated groove 75 is formed such that a slope 75*e*, which inclines with respect to the sliding surface 72, is connected to a planar groove bottom 75*f* with a predetermined width adjacent to the inner and outer peripheral contours 75*a* and 75*b*. The groove depth as a difference in height from the sliding surface 72 to the groove bottom 75*f* is smaller than the width of the beginning portion 75*c* of the elongated groove 75.

The opening bores 77*a* to 77*e* are opened to the elongated groove 75 from the outside of the gear accommodation chamber 70*a*. Specifically, each of the opening bores 77*a* to 77*e* is formed in a circular cylindrical bore shape that passes through the pump cover 71 along the axial direction Da. As specifically shown in FIG. 5, on the outer side of each of the opening bores 77*a* to 77*e*, the entire cylindrical end surface EFo is opened to the outside of the fuel pump 100 as the outside of the gear accommodation chamber 70*a*. As specifically shown in FIG. 4, on the inner side of each of the opening bores 77*a* to 77*e*, the entire cylindrical end surface EFi is opened to the elongated groove 75. Thus, as specifically shown in FIG. 6, the inner diameter Dh of each of the opening bores 77*a* to 77*e* is substantially constant at every position from the outer side to the inner side. The bore length Lh of each of the opening bores 77*a* to 77*e* is set larger than the inner diameter Dh of the opening bore. In the first embodiment, five opening bores 77*a* to 77*e* are provided in the suction port part 74.

Each of the ribs 78*a* to 78*d* is disposed between the adjacent two of the opening bores 77*a* to 77*e* on both sides in the extending direction on a side opposite to the gear accommodation chamber 70*a* with respect to the elongated groove 75. The respective ribs 78*a* to 78*d* serve as bulkheads between the opening bores 77*a* to 77*e* and reinforce the pump cover 71. The number of ribs 78*a* to 78*d* is smaller by one than the number of the opening bores 77*a* to 77*e*, and specifically four in the first embodiment. The ribs 78*a* to 78*d* are formed such that their minimum widths Wr are substantially equal to one another. A portion in which each of the ribs 78*a* to 78*d* has the minimum width Wr is located on a virtual straight line connecting between the centers of adjacent two of the opening bores 77*a* to 77*e* on both sides of the rib.

Such opening bores 77*a* to 77*e* and ribs 78*a* to 78*d* have an arrangement structure 76, in which the opening bores and the ribs are alternately arranged along the extending direction of the elongated groove 75. As a result, the ribs 78*a* to 78*d* are formed so as to connect the inner peripheral contour 75*a* and the outer peripheral contour 75*b* of the elongated groove 75 along the width direction of the elongated groove 75. Each of the ribs 78*a* to 78*d* is formed in a columnar shape along the adjacent two of the opening bores 77*a* to 77*e* on both sides in the extending direction from the outer cylindrical end surface EFo to the inner cylindrical end surface EFi. Since each of the opening bores 77*a* to 77*e* is formed in the circular cylindrical bore shape, each of side surfaces 79*a*, which face both sides in the extending direction, of each of the ribs 78*a* to 78*d* has a cylindrical concave surface shape.

Each of such opening bores 77*a* to 77*e* is opened inside the elongated groove 75 with respect to each of the inner peripheral contour 75*a* and the outer peripheral contour 75*b* of the elongated groove 75. Hence, the inner diameter Dh of each of the opening bores 77*a* to 77*e* is set smaller than the width of the elongated groove 75 in the portion where that opening bore is disposed. In detail, each of the opening bores 77*a* to 77*e* is opened so as to reach the slope 75*e* on both sides in the width direction. In this way, the slope 75*e* has a partially cut-out shape by opening of each of the opening bores 77*a* to 77*e*.

The inner diameter Dh and the opening area of each of the opening bores 77*a* to 77*e* arranged together in the suction port part 74 are set in accordance with the width of the elongated groove 75 that widens as going from the small deviation-angle side to the large deviation-angle side. That is, the inner diameter Dh and the opening area of each of the opening bores 77*a* to 77*e* positively correlate with the width of the elongated groove 75 corresponding to a position of that opening bore.

Figure 5:
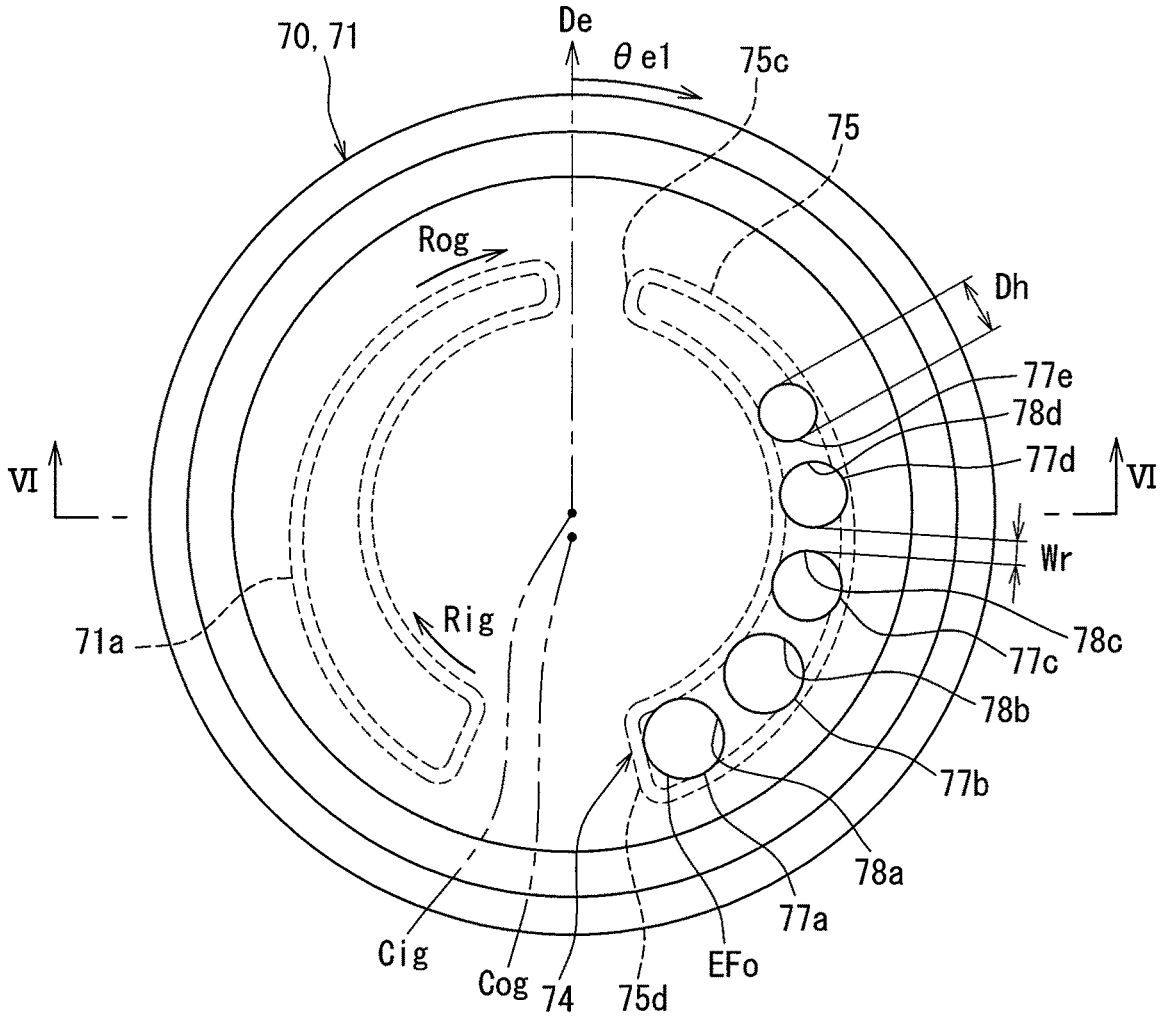
FIG. 5 is a plan view of the pump cover as seen in a V direction in FIG. 1.
Figure 6:
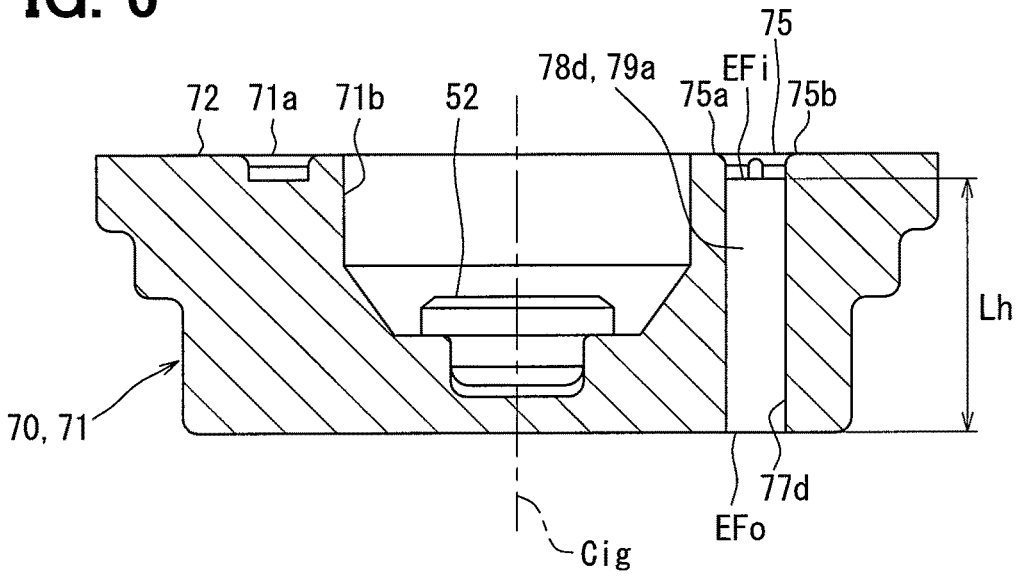
FIG. 6 is a sectional view along a line VI-VI in FIG. 4 or 5.

Specifically, when the opening bores 77*a* to 77*e* are compared to one another, as specifically shown in FIGS. 4 and 5, the first opening bore 77*a* from the large deviation-angle side has the largest inner diameter Dh. The inner diameter Dh of the second opening bore 77*b* is smaller than that of the first opening bore 77*a* and larger than that of each of the third to fifth opening bores 77*c* to 77*e*. The inner diameter Dh of the third opening bore 77*c* is substantially equal to that of the fourth opening bore 77*d*. The inner diameter Dh of each of the third and fourth opening bores 77*c* and 77*d* is smaller than that of each of the first and second opening bores 77*a* and 77*b* and larger than that of the fifth opening bore 77*e*. Hence, the fifth opening bore 77*e* has the smallest inner diameter Dh.

Since the opening area of each of the opening bores 77*a* to 77*e* in the elongated groove 75 corresponds to area of the tubular end surface EFi of each of the tubular opening bores 77*a* to 77*e*, the opening area is according to the inner diameter Dh of each of the opening bores 77*a* to 77*e*. To arrange based on this, among the opening bores 77*a* to 77*e*, the opening bore 77*a* located at a position providing the largest deviation angle θe1 has a larger opening area than each of other opening bores 77*b* to 77*e*.

Among the opening bores 77*a* to 77*e*, special opening bores 77*a*, 77*b*, and 77*d* have respective opening areas larger than respective opening areas of the adjacent opening bores 77*b*, 77*c*, and 77*e* on the smaller deviation-angle side across the respective ribs 78*a*, 78*b*, and 78*d*. In the first embodiment, a relationship between the first opening bore 77*a* and the second opening bore 77*b*, a relationship between the second opening bore 77*b* and the third opening bore 77*c*, and a relationship between the fourth opening bore 77*d* and the fifth opening bore 77*e* each correspond to such a relationship of the opening area.

The arrangement structure 76 is formed from the end portion 75*d*, at which the deviation angle θe1 is 90° or larger, to a predetermined boundary position Pb, at which the deviation angle θe1 is smaller than 90°, in the elongated groove 75. On the other hand, on a smaller deviation-angle side with respect to the boundary position Pb, the groove bottom 75*f* extends from the boundary position Pb to the beginning portion 75*c* while the arrangement structure 76 is not formed, and thus the elongated bottom portion 75*g* is formed.

The pump casing 80 shown in FIGS. 1 and 7 to 9 is a component of the pump housing 70. The pump casing 80 is formed in a bottomed cylindrical shape having wear resistance by performing surface treatment such as plating on a substrate including a stiff metal such as steel. An opening 80*c* of the pump casing 80 is covered with the pump cover 71 so as to be closed over the entire circumference. The inner peripheral portion 80*d* of the pump casing 80 is formed in a cylindrical bore shape that is eccentric to the inner center line Cig and coaxial with the outer peripheral line Cog.

A radial bearing 50 is fixedly fitted on the inner center line Cig in a concave bottom portion 80*e* of the pump casing 80 in order to radially bear the rotation shaft 3*a*, which passes through the concave bottom portion 80*e*, of the electromotive motor 3.

The pump casing 80 has a discharge port part 84, which discharges the fuel from the inside to the outside of the gear accommodation chamber 70*a*, on the outer periphery side of the radial bearing 50. The discharge port part 84 has an elongated groove 85, a plurality of opening bores 87*a*, 87*b*, 87*c*, 87*d*, and 87*e*, and a plurality of ribs 88*a*, 88*b*, 88*c*, and 88*d*.

Figure 7:
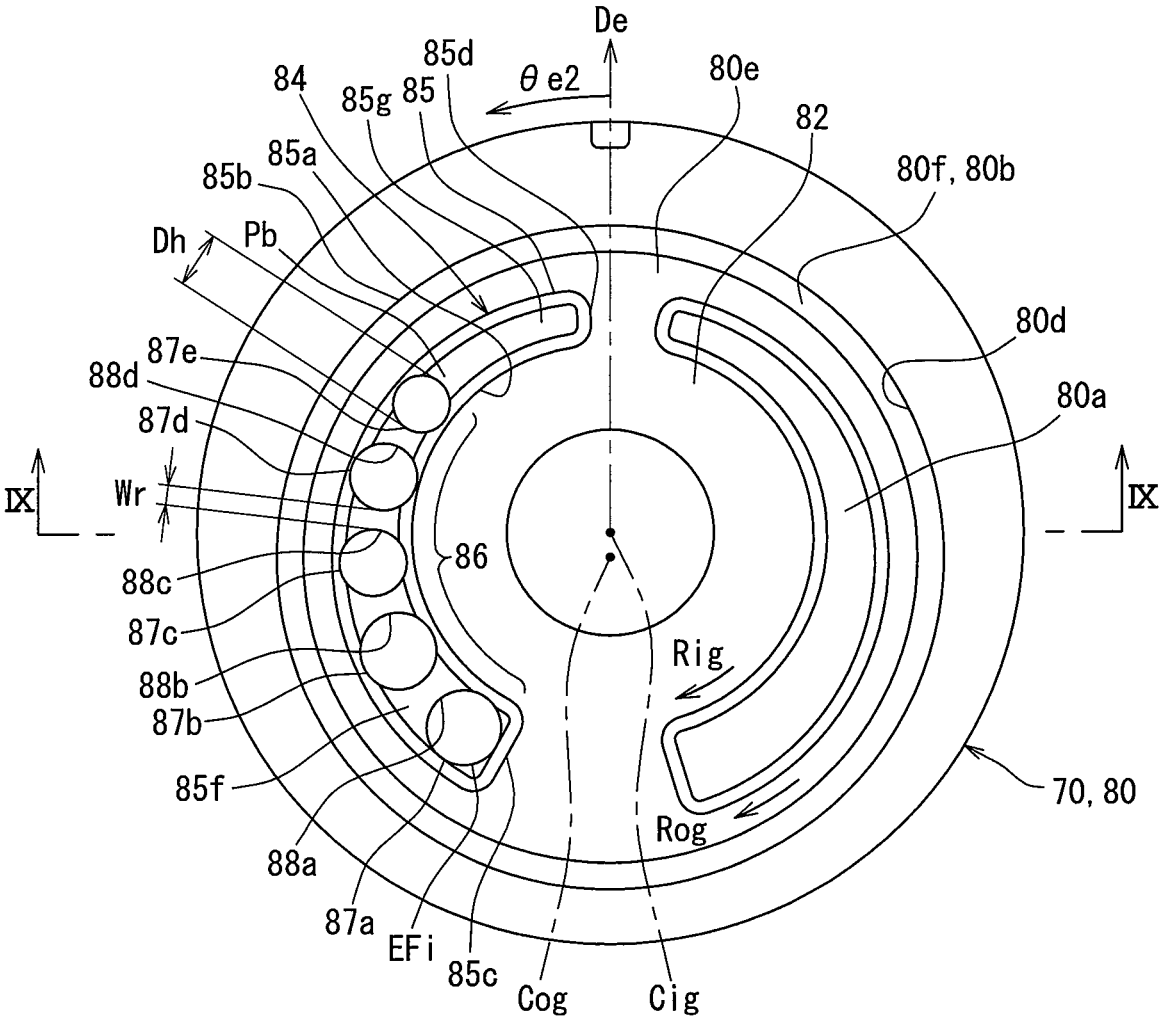
FIG. 7 is a plan view of a pump casing as seen in a VII direction in FIG. 1.
Figure 8:
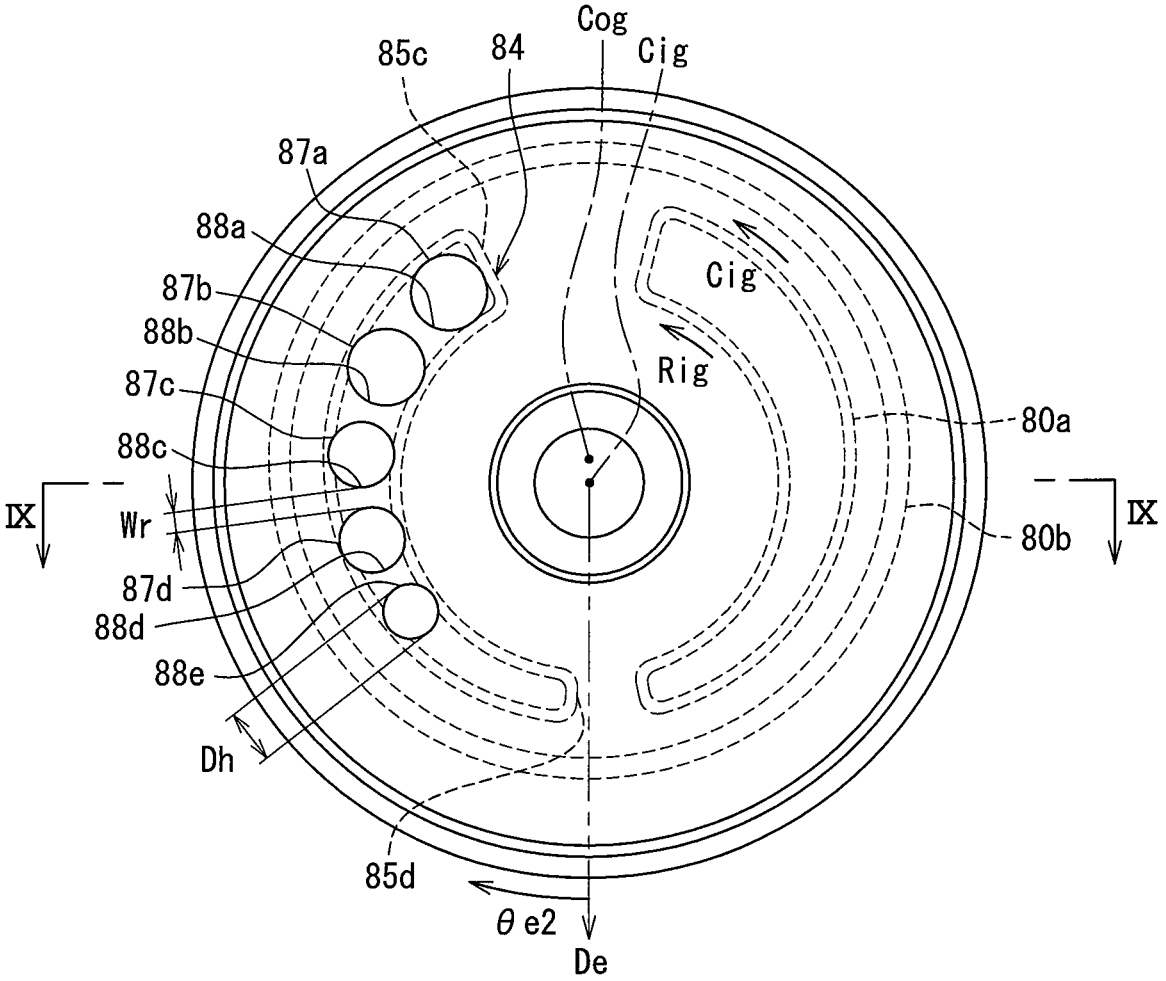
FIG. 8 is a plan view of the pump casing as seen in a VIII direction in FIG. 1.
Figure 9:
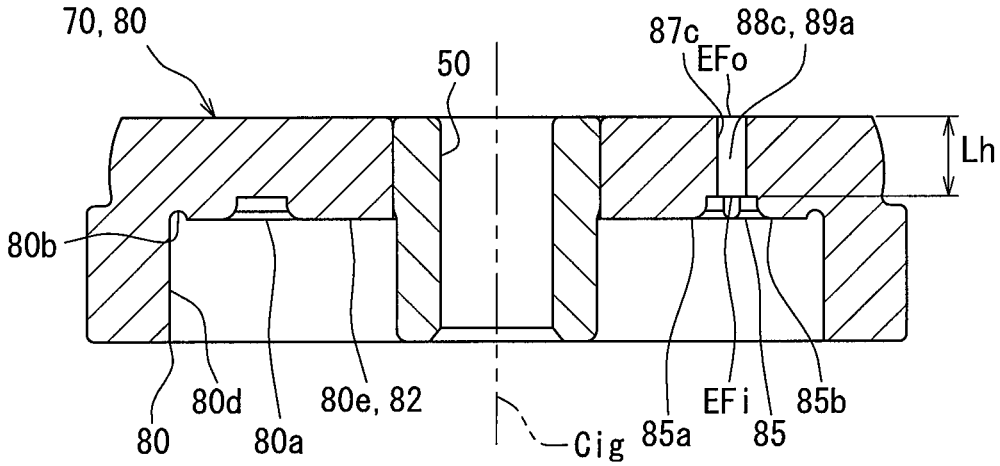
FIG. 9 is a sectional view along a line IX-IX in FIG. 7 or 8.

As specifically shown in FIG. 7, the elongated groove 85 is formed by being depressed from a sliding surface 82, which configures a part of the concave bottom portion 80*e* of the pump casing 80, in a portion opposed to the pump chambers 40 located in the discharge area AR2 of the gear accommodation chamber 70*a*. The elongated groove 85 has an arcuate groove shape extending along the circumferential direction of the pump casing 80. In detail, an inner peripheral contour 85*a* of the elongated groove 85 extends in a length shorter than the semicircle along the rotational direction Rig. An outer peripheral contour 85*b* of the elongated groove 85 extends in a length shorter than the semicircle along the rotational direction Rog.

The elongated groove 85 is gradually narrowed as going from a beginning portion 85*c* to an end portion 85*d* in the drive rotation direction. In other words, the elongated groove 85 is gradually widened as going from a small deviation-angle side, on which a deviation angle θe2 is small, to a large deviation-angle side, on which the deviation angle θe2 is large. Inside each of the inner peripheral contour 85*a* and the outer peripheral contour 85*b* of the elongated groove 85, the elongated groove 85 is formed such that a slope 85*e*, which inclines with respect to the sliding surface 82, is connected to a planar groove bottom 85*f* with a predetermined width adjacent to the inner and outer peripheral contours 85*a* and 85*b*. The groove depth as a difference in height from the sliding surface 82 to the groove bottom 85*f* is smaller than the width of the end portion 85*d* of the elongated groove 85.

The opening bores 87*a* to 87*e* are opened to the elongated groove 85 from the outside of the gear accommodation chamber 70*a*. Specifically, each of the opening bores 87*a* to 87*e* is formed in a circular cylindrical bore shape that passes through the pump casing 80 along the axial direction Da. As specifically shown in FIG. 8, on the outer side of each of the opening bores 87*a* to 87*e*, the entire cylindrical end surface EFo is opened to the outside of the fuel pump 100 as the outside of the gear accommodation chamber 70*a*. As specifically shown in FIG. 7, on the inner side of each of the opening bores 87*a* to 87*e*, the entire cylindrical end surface EFi is opened to the elongated groove 85. Thus, as specifically shown in FIG. 9, the inner diameter Dh of each of the opening bores 87*a* to 87*e* is substantially constant at every point from the outer side to the inner side. The bore length Lh of each of the opening bores 87*a* to 87*e* is set larger than the inner diameter Dh of the opening bore. In the first embodiment, five opening bores 87*a* to 87*e* are provided in the discharge port part 84.

Each of the ribs 88*a* to 88*d* is disposed between the adjacent two of the opening bores 87*a* to 87*e* on both sides in the extending direction on a side opposite to the gear accommodation chamber 70*a* with respect to the elongated groove 85. The respective ribs 88*a* to 88*d* serve as bulkheads between the opening bores 87*a* to 87*e* and reinforce the pump casing 80. The number of ribs 88*a* to 88*d* is smaller by one than the number of the opening bores 87*a* to 87*e*, and specifically four in the first embodiment. The ribs 78*a* to 78*d* are formed such that their minimum widths Wr are substantially equal to one another.

Such opening bores 87*a* to 87*e* and ribs 88*a* to 88*d* have an arrangement structure 86, in which the opening bores and the ribs are alternately arranged along the extending direction of the elongated groove 85. As a result, the ribs 88*a* to 88*d* are formed so as to connect the inner peripheral contour 85*a* and the outer peripheral contour 85*b* of the elongated groove 85 along the width direction of the elongated groove 85. Each of the ribs 88*a* to 88*d* is formed in a columnar shape along the adjacent two of the opening bores 87*a* to 87*e* on both sides in the extending direction from the outer cylindrical end surface EFo to the inner cylindrical end surface EFi. Since each of the opening bores 87*a* to 87*e* is formed in the circular cylindrical bore shape, each of side surfaces 89*a*, which face both sides in the extending direction, of each rib has a cylindrical concave surface shape.

Each of such opening bores 87*a* to 87*e* is opened inside the elongated groove 85 with respect to each of the inner peripheral contour 85*a* and the outer peripheral contour 85*b* of the elongated groove 85. Hence, the inner diameter Dh of each of the opening bores 87*a* to 87*e* is set smaller than the width of the elongated groove 85 in the portion where that opening bore is disposed. In detail, each of the opening bores 87*a* to 87*e* is opened so as to reach the slope 85*e* on both sides in the width direction. Thus, the slope 85*e* has a partially cut-out shape by opening of each of the opening bores 87*a* to 87*e*.

The inner diameter Dh and the opening area of each of the opening bores 87*a* to 87*e* arranged together in the discharge port part 84 are set in accordance with the width of the elongated groove 85 that narrows as going from the large deviation-angle side to the small deviation-angle side. When the opening bores 87*a* to 87*e* are compared to one another, as specifically shown in FIGS. 7 and 8, the first opening bore 87*a* from the large deviation-angle side has the largest inner diameter Dh. The inner diameter Dh of the second opening bore 87*b* is smaller than that of the first opening bore 87*a* and larger than that of each of the third to fifth opening bores 87*c* to 87*e*. The inner diameter Dh of the third opening bore 87*c* is substantially equal to that of the fourth opening bore 87*d*. The inner diameter Dh of each of the third and fourth opening bores 87*c* and 87*d* is smaller than that of each of the first and second opening bores 87*a* and 87*b* and larger than that of the fifth opening bore 87*e*. Hence, the fifth opening bore 87*e* has the smallest inner diameter Dh.

Since the opening area of each of the opening bores 87*a* to 87*e* in the elongated groove 85 corresponds to area of the tubular end surface EFi of each of the tubular opening bores 87*a* to 87*e*, the opening area is according to the inner diameter Dh of each of the opening bores 87*a* to 87*e*. To arrange based on this, among the opening bores 87*a* to 87*e*, the opening bore 87*a* located at a position providing the largest deviation angle θe2 has a larger opening area than each of other opening bores 87*b* to 87*e*.

Among the opening bores 87*a* to 87*e*, special opening bores 87*a*, 87*b*, and 87*d* have respective opening areas larger than respective opening areas of the adjacent opening bores 87*b*, 87*c*, and 87*e* on the smaller deviation-angle side across the respective ribs 88*a*, 88*b*, and 88*d*. In the first embodiment, a relationship between the first opening bore 87*a* and the second opening bore 87*b*, a relationship between the second opening bore 87*b* and the third opening bore 87*c*, and a relationship between the fourth opening bore 87*d* and the fifth opening bore 87*e* each correspond to such a relationship of the opening area.

The arrangement structure 86 is formed from the beginning portion 85*c*, at which the deviation angle θe2 is 90° or larger, to a predetermined boundary position Pb, at which the deviation angle θe2 is smaller than 90°, in the elongated groove 85. On the other hand, on a smaller deviation-angle side with respect to the predetermined boundary position, the groove bottom 85*f* of the elongated groove 85 extends from the boundary position Pb to the end portion 85*d* while the arrangement structure 86 is not formed, and thus the elongated bottom portion 85*g* is formed.

The suction port part 74 is now compared to the discharge port part 84 with reference to FIGS. 4 and 7. The first opening bore 77*a* of the suction port part 74 and the first opening bore 87*a* of the discharge port part 84 have a substantially equal inner diameter Dh and a substantially equal opening area. A similar relationship is established between the second to fifth opening bores 77*b* to 77*e* of the suction port part 74 and the second to fifth opening bores 87*b* to 87*e* of the discharge port part 84, respectively. Hence, when n is assumed to be a natural number, one of the opening bores 77*a* to 77*e* as an nth opening bore from the large deviation-angle side of the suction port part 74 and one of the opening bores 84*a* to 84*e* as an nth opening bore from the large deviation-angle side of the discharge port part 84 have a substantially equal inner diameter ID and a substantially equal opening area. Thus, the sum of the opening area of the opening bores 77*a* to 77*e* of the suction port part 74 is equal to the sum of the opening area of the opening bores 87*a* to 87*e* of the discharge port part 84.

As specifically shown in FIG. 7, an arcuate counter suction groove 80*a* is formed in correspondence to a shape formed by projecting the elongated groove 75 in the axial direction Da in a portion opposed to the elongated groove 75 of the suction port part 74 across the pump chambers 40 in the concave bottom portion 80*e* of the pump casing 80. The counter suction groove 80*a* is depressed from the sliding surface 82, and is opened to a side close to the gear accommodation chamber 70*a*. Consequently, in the pump casing 80, the elongated groove 85 of the discharge port part 84 is provided to have the contours 85*a* and 85*b* that are substantially line-symmetric to the counter suction groove 80*a*. Thus, the elongated groove 85 of the discharge port part 84 is separated by the sliding surface 82 from the counter suction groove 80*a*.

Further, a circular groove 80*b*, which is depressed from the sliding surface 82 in the axial direction Da, is formed in an inner-diameter corner portion 80*f* opposed to an outer peripheral portion 34 of the outer gear 30 on an outer periphery side of the discharge port part 84 and the counter suction groove 80*a* in the concave bottom portion 80*e* of the pump casing 80. The circular groove 80*b* is formed to communicate between the suction area AR1 on the outer periphery side of the counter suction groove 80*a* and the discharge area AR2 on the outer periphery side of the discharge port part 84 over the entire circumference.

On the other hand, as specifically shown in FIG. 4, an arcuate counter discharge groove 71*a* is formed in correspondence to a shape formed by projecting the elongated groove 85 in the axial direction Da in a portion opposed to the elongated groove 85 of the discharge port part 84 across the pump chambers 40 in the pump cover 71. The counter discharge groove 71*a* is depressed from the sliding surface 72, and is opened to a side close to the gear accommodation chamber 70*a* of the pump cover 71. Consequently, in the pump cover 71, the elongated groove 75 of the suction port part 74 is provided to have the contours 75*a* and 75*b* that are substantially line-symmetric to the counter discharge groove 71*a* across the joint accommodation chamber 71*b*. Thus, the elongated groove 75 of the suction port part 74 is separated by the sliding surface 72 from the counter discharge groove 71*a*.

As shown in FIGS. 1 and 3, the inner gear 20 is formed such that its thickness is slightly smaller than a size between the pair of sliding surfaces 72 and 82 in the gear accommodation chamber 70*a* defined by such a pump housing 70. Thus, the inner gear 20 is born in the radial direction at its inner peripheral portion 22 by the radial bearing 50, and is born on both sides in the axial direction Da by the pair of sliding surfaces 72 and 82.

The outer gear 30 is formed such that its outer diameter is slightly smaller than the inner diameter of the pump casing 80. In addition, the outer gear 30 is formed such that its thickness is slightly smaller than the size between the pair of sliding surfaces 72 and 82. Thus, the outer gear 30 is born at its outer peripheral portion 34 by an inner periphery portion 80*d* of the pump casing 80, and is born on both sides in the axial direction Da by the pair of sliding surfaces 72 and 82.

The volume of each pump chamber 40, which is oppositely in communication with the suction port part 74 and the counter suction groove 80*a*, expands along with rotation of the gears 20 and 30. As a result, fuel is sucked into the pump chambers 40 within the gear accommodation chamber 70*a* through the opening bores 77*a* to 77*e* of the suction port part 74. The ribs 78*a* to 78*d* provided between the opening bores 77*a* to 77*e* opened to the elongated groove 75 depressed from the sliding surface 72 are opposed to the pump chambers 40 across a space in the elongated groove 75. Hence, while the pump chamber 40 is opposed to each of the ribs 78*a* to 78*d*, fuel is continuously sucked from adjacent two of the opening bores 77*a* to 77*e* on both sides in the extending direction.

The volume of each pump chamber 40, which is oppositely in communication with the discharge port part 84 and the counter discharge groove 71*a*, reduces along with rotation of the gears 20 and 30. As a result, fuel is discharged to the outside of the gear accommodation chamber 70*a* from the pump chambers 40 through the opening bores 87*a* of the discharge port part 84. The ribs 88*a* to 88*d* provided between the opening bores 87*a* to 87*e* opened to the elongated groove 85 depressed from the sliding surface 82 are opposed to the pump chambers 40 across a space in the elongated groove 85. Hence, while the pump chamber 40 is opposed to each of the ribs 88*a* to 88*d*, fuel is continuously discharged into adjacent two of the opening bores 87*a* to 87*e* on both sides in the extending direction.

As described above, the fuel, which is sequentially sucked into the pump chambers 40 in the gear accommodation chamber 70*a* through the suction port part 74 and then discharged through the discharge port part 84, is discharged from the discharge outlet 5*b* of the side cover 5 to the outside of the fuel pump 100 through the fuel passage 6. The fuel pressure of the fuel passing through the discharge port part 84 is high relative to the fuel pressure of the fuel passing through the suction port part 74 due to the above-described pump function.

The functions and effects of the first embodiment described as above are now described.

In the first embodiment, the opening bores 77*a* to 77*e* and the ribs 78*a* to 78*d* are alternately arranged along the extending direction of the elongated groove 75 in the suction port part 74. In addition, the opening bores 87*a* to 87*e* and the ribs 88*a* to 88*d* are alternately arranged along the extending direction of the elongated groove 85 in the discharge port part 84. The plurality of opening bores 77*a* to 77*e* or 87*a* to 87*e* are provided so as to be opened to the elongated groove 75 or 85 from the outside of the gear accommodation chamber 70*a*. The ribs 78*d* to 78*d* or 88*a* to 88*d* are disposed between the opening bores 77*a* to 77*e* or 87*a* to 87*e*. Such alternate arrangement makes it possible to improve stiffness of the pump housing 70 while the plurality of opening bores 77*a* to 77*e* or 87*a* to 87*e* are provided.

As described above, the elongated groove 75 or 85 having the plurality of opening bores 77*a* to 77*e* or 87*a* to 87*e* is provided while being depressed from the sliding surface 72 or 82 and extending along the circumferential direction of the pump housing 70 in a portion opposed to the plurality of pump chambers 40 formed between the outer gear 30 and the inner gear 20. The volume of each of the pump chambers 40 opposed to such an elongated groove 75 or 85 is expanded and reduced along with rotation of the gears 20 and 30. Such expansion and reduction allow the fuel to be sucked into the gear accommodation chamber 70*a* and then discharged.

The respective pump chambers 40 opposed to the respective opening bores 77*a* to 77*e* or 87*a* to 87*e* directly suck or discharge the fuel from/into the corresponding opening bores 77*a* to 77*e* or 87*a* to 87*e*. Each of the pump chambers 40 opposed to the ribs 78*a* to 78*d* or 88*a* to 88*d* sucks or discharges the fuel from/into two of the opening bores 77*a* to 77*e* or 87*a* to 87*e* on both sides of a relevant rib through the space in the elongated groove 75 or 85. Thus, since the pump chambers 40 opposed to the port part 74 or 84 can successively perform the suction or the discharge, the fuel is sucked or discharged successfully using the expansion and reduction of the volume of the pump chamber 40. It is therefore possible to provide the fuel pump 100 having a high pump efficiency.

In the first embodiment, among the opening bores 77*a* to 77*e* or 87*a* to 87*e* arranged together, the opening bore 77*a* or 87*a* located at a position providing the largest deviation angle has an opening area larger than the opening area of each of the remaining opening bores 77*b* to 77*e* or 87*b* to 87*e*. This makes it possible to perform the suction or the discharge in accordance with the large volume of the pump chamber 40 at a position providing a large deviation angle, and thus the pump efficiency can be improved by successfully using the expansion and reduction of the volume of the pump chamber 40.

In the first embodiment, the respective opening areas of special opening bores 77*a*, 77*b*, and 77*d* or 87*a*, 87*b*, and 87*d* are large relative to the respective opening areas of the adjacent opening bores 77*b*, 77*c*, and 77*e* or 87*b*, 87*c*, and 87*e* on the smaller deviation-angle side across the ribs 78*a*, 78*b*, and 78*d* or 88*a*, 88*b*, and 88*d*. On the other hand, the volume of each pump chamber 40 is also relatively small on the smaller deviation-angle side and relatively large on the larger deviation-angle side, and thus the fuel can be sucked or discharged in accordance with the expansion and reduction of the volume of the pump chamber 40.

In detail, the flow velocities of the passing fuel are similar to each other between the special opening bores 77*a*, 77*b*, 77*d* or 87*a*, 87*b*, 87*d* and the adjacent opening bores 77*b*, 77*c*, 77*e* or 87*b*, 87*c*, 87*e*, respectively, due to the opening areas in accordance with the volumes of the pump chambers 40. This suppresses reciprocation of the fuel between the side of the special opening bores 77*a*, 77*b*, 77*d* or 87*a*, 87*b*, 87*d* and the side of the adjacent opening bores 77*b*, 77*c*, 77*e* or 87*b*, 87*c* 87*e* in the space in the elongated groove 75 or 85, leading to more direct suction or discharge of the fuel from/into the opposed pomp chamber 40. Consequently, the fuel is more smoothly sucked or discharged, leading to higher pump efficiency.

In the first embodiment, the elongated groove 75 or 85 is gradually widened as going from the small deviation-angle side to the large deviation-angle side, and the opening areas of the opening bores 77*a* to 77*e* or 87*a* to 87*e* are set in accordance with the width of the elongated groove 75 or 85. In this way, each opening area is set in correspondence to the pump chamber 40, the volume of which increases with an increase in the deviation angle θe1 or θe2, making it possible to make the flow velocities of the fuel, which passes through the opening bores 77*a* to 77*e* or 87*a* to 87*e*, to be close to one another. This suppresses reciprocation of the fuel between the large deviation-angle side and the small deviation-angle side in the space in the elongated groove 75 or 85, leading to more direct suction or discharge of the fuel between the pump chambers 40 and the opposed opening bores 77*a* to 77*e* or 87*a* to 87*e*. Consequently, the fuel is more smoothly sucked or discharged, leading to higher pump efficiency.

In the first embodiment, the tubular end surface EFi is entirely opened to the elongated groove 75 or 85 in each of the tubular opening bores 77*a* to 77*e* or 87*a* to 87*e*. Hence, while generation of cavitation due to an abrupt change in pressure at the opening portion is suppressed, more direct suction or discharge of the fuel from/into the opposed pump chamber 40 is performed compared with the case where only a part of the cylindrical end surface EFi is opened. Consequently, the pump efficiency is improved.

In the first embodiment, since the opening bores 77*a* to 77*e* or 87*a* to 87*e* each have a circular cylindrical bore shape, the fuel can be sucked or discharged while the flow rate is increased for the cross section of each of the opening bores 77*a* to 77*e* or 87*a* to 87*e*. Furthermore, since the side surface 79*a* or 89*a* of each of the ribs 78*a* to 78*d* or 88*a* to 88*d* between the opening bores 77*a* to 77*e* or 87*a* to 87*e* can be formed into a cylindrical concave surface shape, stress concentration to a special site of each of the ribs 78*a* to 78*d* or 88*a* to 88*d* can be suppressed to increase strength of the ribs 78*a* to 78*d* or 88*a* to 88*d*.

In the first embodiment, each of the opening bores 77*a* to 77*e* or 87*a* to 87*e* is opened inside each of the contours 75*a* and 75*b* or 85*a* and 85*b* of the elongated groove 75 or 85. This can suppress a decrease in sliding area between the sliding surface 72 or 82 and the gears 20 and 30 due to opening of the opening bores 77*a* to 77*e* or 87*a* to 87*e*. Thus, the sealing performance between the sliding surface 72 or 82 and the gears 20 and 30 is maintained, making it possible to suppress leakage of the fuel from the pump chamber 40. Consequently, the pump efficiency is improved.

In the first embodiment, the joint accommodation chamber 71*b* accommodating the joint member 60 is depressed from the same sliding surface 72 as the sliding surface from which the elongated groove 75, which allows the opening bores 77*a* to 77*e* and the ribs 78*a* to 78*d* to be disposed therein, is depressed. Although a reduction in stiffness of the pump housing 70 is concerned due to such a joint accommodation chamber 71*b*, since the plurality of ribs 78*a* to 78*d* are provided on a side of the elongated groove 75 depressed from the same sliding surface 72 as the sliding surface from which the joint accommodation chamber 71*b* is depressed, such a reduction in stiffness can be suppressed. It is therefore possible to suppress an increase in sliding resistance associated with deformation of the sliding surface 72 from which the joint accommodation chamber 71*b* is depressed, and thus a fuel pump having a high pump efficiency can be provided.

In the first embodiment, the arrangement structure 76 including the alternately arranged opening bores 77*a* to 77*e* and ribs 78*a* to 78*d* is provided in the suction port part 74, while the arrangement structure 86 including the alternately arranged opening bores 87*a* to 87*e* and ribs 88*a* to 88*d* is provided in the discharge port part 84. Consequently, the pump chambers 40 opposed to the suction port part 74 can successively suck the fuel, while the pump chambers 40 opposed to the discharge port part 84 can successively discharge the fuel. Thus, the fuel is sucked and discharged successfully using the expansion and reduction of the volume of the pump chamber 40, leading to improvement in pump efficiency.

In the first embodiment, the sum of the opening areas of the opening bores 77*a* to 77*e* of the suction port part 74 is equal to the sum of the opening areas of the opening bores 87*a* to 87*e* of the discharge port part 84. This allows the shapes of the opening bores 77*a* to 77*e* of the suction port part 74 to be the same as the shapes of the opening bores 87*a* to 87*e* of the discharge port part 84. It is therefore possible to provide the fuel pump 100 that is easily manufactured and has a high pump efficiency.

In the first embodiment, the minimum widths Wr of the ribs 78*a* to 78*d* or 88*a* to 88*d* arranged together are equal to one another. Thus, the stiffness of the port part 74 or 84 is homogenized in the circumferential direction of the pump housing 70, and, for example, it is possible to suppress stress concentration, which may cause an origin of deformation, to one of the ribs 78*a* to 78*d* or 87*a* to 87*d*.

Second Embodiment

Figure 10A:
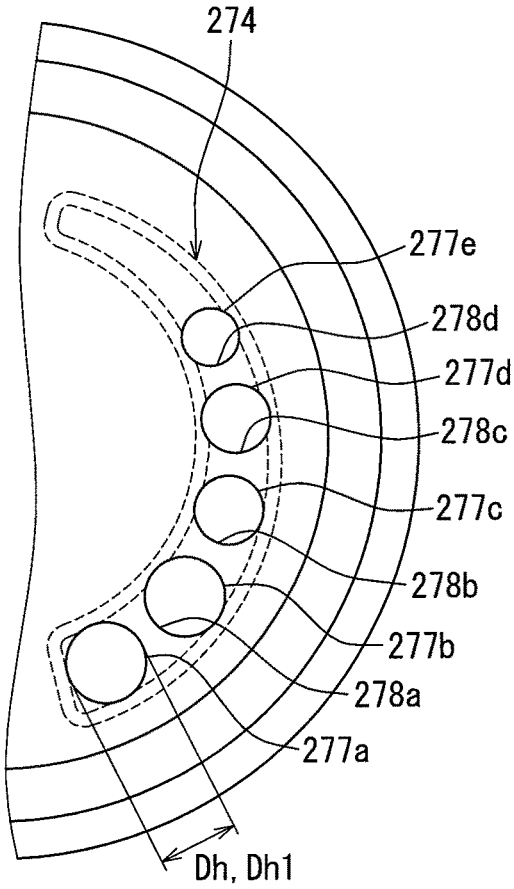
FIGS. 10A and 10B are views for comparing opening bores in a suction port part to opening bores in a discharge port part in a second embodiment, where
Figure 10B:
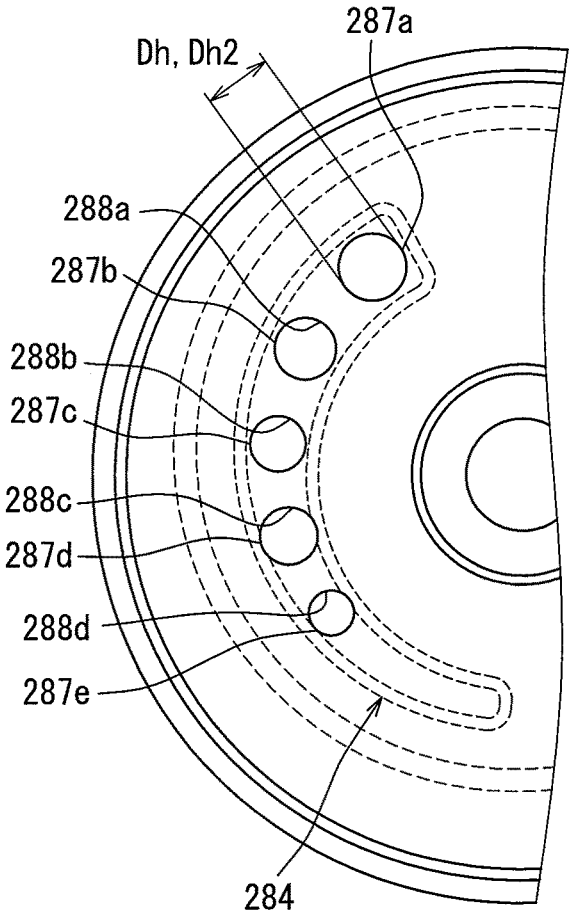

As shown in FIGS. 10A and 10B, a second embodiment is a modification of the first embodiment. The second embodiment is mainly described in points different from the first embodiment.

A suction port part 274 and a discharge port part 284 of a fuel pump of the second embodiment are compared to each other. The inner diameter Dh1 of a first opening bore 277*a* of the suction port part 274 is larger than the inner diameter Dh2 of a first opening bore 287*a* of the discharge port part 284. A similar relationship is established on the inner diameter Dh between the second to fifth opening bores 277*b* to 277*e* of the suction port part 274 and the second to fifth opening bores 287*b* to 287*e* of the discharge port part 284, respectively. Hence, when n is assumed to be a natural number, one of the opening bores 277*a* to 277*e* as an nth opening bore from the large deviation-angle side of the suction port part 274 has an inner diameter Dh larger than that of one of the opening bores 287*a* to 287*e* as an nth opening bore from the large deviation-angle side of the discharge port part 284.

As a result, the opening area of the first opening bore 277*a* of the suction port part 274 is larger than the opening area of the first opening bore 287*a* of the discharge port part 284. A similar relationship is established on the opening area between the second to fifth opening bores 277*b* to 277*e* of the suction port part 274 and the second to fifth opening bores 287*b* to 287*e* of the discharge port part 284, respectively. Hence, one of the opening bores 277*a* to 277*e* as an nth opening bore from the large deviation-angle side of the suction port part 274 has an opening area larger than that of one of the opening bores 287*a* to 287*e* as an nth opening bore from the large deviation-angle side of the discharge port part 284.

Thus, the sum of the opening areas of the opening bores 277*a* to 277*e* of the suction port part 274 is larger than the sum of the opening areas of the opening bores 287*a* to 287*e* of the discharge port part 284.

In such a second embodiment, the opening bores 277*a* to 277*e* and the ribs 278*a* to 278*d* are also alternately arranged along the extending direction of the elongated groove 75 in the suction port part 274. The opening bores 287*a* to 287*e* and the ribs 288*a* to 288*d* are also alternately arranged along the extending direction of the elongated groove 85 in the discharge port part 284. Consequently, functions and effects similar to those in the first embodiment can be exhibited.

In the second embodiment, the sum of the opening areas of the opening bores 277*a* to 277*e* of the suction port part 274 is larger than the sum of the opening areas of the opening bores 287*a* to 287*e* of the discharge port part 284. Consequently, a larger amount of fuel can be sucked from the opening bores 277*a* to 277*e* in the suction port part 274 in consideration that the fuel pressure is higher during discharge than during suction. In addition, the opening bores 287*a* to 287*e* of the discharge port part 284 are not opened more than necessary for the suction capacity of the suction port part 274, making it possible to improve the stiffness of the pump housing 70 and thus improve the pump efficiency.

Although several embodiments have been described hereinbefore, the present disclosure should be interpreted without being limited thereto, and can be applied to various embodiments and various combinations within the scope without departing from the gist of the present disclosure. First to twelfth modifications of the above described respective embodiments are described.

Figure 11:
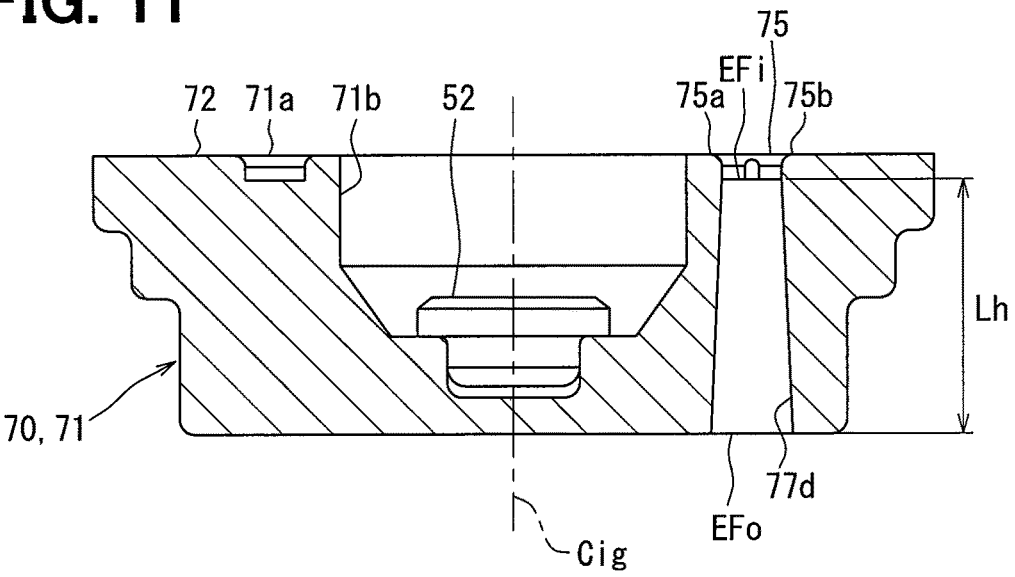
FIG. 11 is a view corresponding to FIG. 6 in a first modification.

Specifically, in the first modification, the inner diameter Dh may be different depending on positions from an outer side to an inner side of the gear accommodation chamber 70*a* in part or all of the opening bores 77*a* to 77*e* or 87*a* to 87*e*. In FIG. 11, the opening bores 77*a* to 77*e* of the suction port part 74 are formed such that the inner diameter Dh is gradually reduced as going from the outer side to the inner side.

In the second modification, part or all of the opening bores 77*a* to 77*e* or 87*a* to 87*e* may be formed into a shape other than the circular cylindrical bore shape, such as a rectangular tubular bore shape, a triangle tubular bore shape, and the like.

In the third modification, part or all of the opening bores 77*a* to 77*e* or 87*a* to 87*e* may be opened such that a part of the cylindrical end surface EFi hangs to the outside of the inner peripheral contour 75*a* or 85*a* or the outside of the outer peripheral contour 75*b* or 85*b*.

In the fourth modification, among the opening bores 77*a* to 77*e* or 87*a* to 87*e* arranged together, the respective opening bores 77*a* to 77*d* or 87*a* to 87*d* other than the opening bore 77*e* or 87*e* on the smallest deviation-angle side may have opening areas that are larger than the opening areas of the respective adjacent opening bores 77*b* to 77*e* or 78*b* to 78*e* on the smaller deviation-angle side across the respective ribs 78*a* to 78*d* or 88*a* to 88*d*.

In the fifth modification, among the opening bores 77*a* to 77*e* or 87*a* to 87*e* arranged together, the respective opening bores 77*b* to 77*e* or 87*b* to 87*e* other than the opening bore 77*a* or 87*a* on the largest deviation-angle side may have the opening areas that are larger than the opening areas of the respective remaining opening bores arranged together.

In the sixth modification, the number of the opening bores 77*a* to 77*e* in the suction port part 74 may be three, four, or six or more. Similarly, the number of the opening bores 87*a* to 87*e* in the discharge port part 84 may be three, four, or six or more.

In the seventh modification, the number of the opening bores 77*a* to 77*e* in the suction port part 74 may be different from the number of the opening bores 87*a* to 87*e* in the discharge port part 84. In addition, the number of the ribs 78*a* to 78*d* in the suction port part 74 may be different from the number of the ribs 88*a* to 88*d* in the discharge port part 84.

In the eighth modification, one of the suction port part 74 and the discharge port part 84 may not form the arrangement structure 76 or 86, in which the opening bores 77*a* to 77*e* or 87*a* to 87*e* or the ribs 78*a* to 78*d* or 88*a* to 88*d* are arranged along the extending direction of the elongated groove 75 or 85.

In the ninth modification, the suction port part 74 and the discharge port part 84 may be provided on the same side in the axial direction Da with respect to the gear accommodation chamber 70*a*.

In the tenth modification, the fuel pump 100 may not include the joint member 60 while the pump housing 70 does not include the joint accommodation chamber 71*b*. Examples of this configuration include a configuration where the rotation shaft 3*a* is directly connected with the inner gear 20.

In the eleventh modification, part or all of the pump housing 70 may be made of aluminum or a material other than metal, such as synthetic resin, for example.

In the twelfth modification, the fuel pump 100 may suck and discharge a fuel other than light oil, such as gasoline or a liquid fuel similar to light oil or gasoline.

While the present disclosure has been described with reference to embodiments thereof, it is to be understood that the disclosure is not limited to the embodiments and constructions. The present disclosure is intended to cover various modification and equivalent arrangements. In addition, the various combinations and configurations, other combinations and configurations, including more, less or only a single element, are also within the spirit and scope of the present disclosure.

The invention claimed is:

1. A fuel pump comprising:

an outer gear that includes a plurality of internal teeth;

an inner gear that includes a plurality of external teeth and is eccentric relative to the outer gear in an eccentric direction to be engaged with the outer gear; and a pump housing that defines a gear accommodation chamber, which rotatably accommodates the outer gear and the inner gear, wherein:

the outer gear and the inner gear expand and contract volumes of a plurality of pump chambers formed between both the gears, and rotate to suction fuel into the gear accommodation chamber and then discharge fuel from the gear accommodation chamber;

the pump housing includes:

a pair of sliding surfaces that clamp the outer gear and the inner gear from both their sides to allow both the gears to slide on the pair of sliding surfaces;

a suction port part that suctions fuel from outside into inside of the gear accommodation chamber; and a discharge port part that discharges fuel from the inside into the outside of the gear accommodation chamber;

at least one of the suction port part and the discharge port part includes:

an elongated groove that is depressed from a corresponding one of the pair of sliding surfaces and extends along a circumferential direction of the pump housing in a region opposed to the plurality of pump chambers;

a plurality of opening bores that open on the elongated groove from the outside of the gear accommodation chamber; and a plurality of ribs each of which is arranged between corresponding adjacent two of the plurality of opening bores; and the plurality of opening bores and the plurality of ribs are arranged alternately along an extending direction of the elongated groove;

each of the plurality of opening bores opens inward of a contour of the elongated groove on the corresponding one of the pair of sliding surfaces and opens outward of a contour of the elongated groove on surfaces of the plurality of ribs.

2. The fuel pump according to claim 1, wherein:

an angle formed relative to the eccentric direction with a center of the inner gear as an apex of the angle is defined as a deviation angle; and one of the plurality of opening bores that is located at a position with the largest deviation angle has an opening area, which is larger than each of opening areas of the rest of the plurality of opening bores.

3. The fuel pump according to claim 2, wherein each of at least one of the plurality of opening bores has an opening area larger than an opening area of a corresponding one of the plurality of opening bores adjacent thereto on a smaller deviation angle side, on which the deviation angle decreases, with a corresponding one of the plurality of ribs therebetween.

4. The fuel pump according to claim 1, wherein:

an angle formed relative to the eccentric direction with a center of the inner gear as an apex of the angle is defined as a deviation angle;

a width of the elongated groove becomes wider from a smaller deviation angle side, on which the deviation angle decreases, toward a larger deviation angle side, on which the deviation angle increases; and an opening area of each of the plurality of opening bores is set in accordance with the width of the elongated groove.

5. The fuel pump according to claim 1, wherein each of the plurality of opening bores has a tubular shape whose entire tubular end surface opens on the elongated groove.

6. The fuel pump according to claim 5, wherein each of the plurality of opening bores has a circular cylindrical bore shape.

7. The fuel pump according to claim 1, further comprising:

a rotation shaft that is rotated; and a joint member that links the rotation shaft to the inner gear to rotate the outer gear and the inner gear, wherein:

the pump housing further includes a joint accommodation chamber that accommodates the joint member;

the joint accommodation chamber is depressed from one of the pair of sliding surfaces; and the elongated groove, where the plurality of opening bores and the plurality of ribs are arranged, is depressed from the one of the pair of sliding surfaces.

8. The fuel pump according to claim 1, wherein each of the suction port part and the discharge port part includes an arrangement structure of the plurality of opening bores and the plurality of ribs that are alternately arranged.

9. The fuel pump according to claim 8, wherein a sum of opening areas of the plurality of opening bores of the suction port part is equal to a sum of opening areas of the plurality of opening bores of the discharge port part.

10. The fuel pump according to claim 8, wherein a sum of opening areas of the plurality of opening bores of the suction port part is larger than a sum of opening areas of the plurality of opening bores of the discharge port part.

11. The fuel pump according to claim 1, wherein minimum widths of the plurality of ribs are the same as each other.

12. The fuel pump according to claim 1, wherein respective inner diameters of the plurality of opening bores on one of the pair of sliding surfaces is greater than respective inner diameters of the plurality of opening bores on an other of the pair of sliding surfaces.

13. The fuel pump according to claim 1, wherein each of the suction port part and the discharge port part includes the elongated groove, the plurality of opening bores, and the plurality of ribs.

* * * * *